US006003629A

United States Patent [19]

Cloutier et al.

[11] Patent Number: 6,003,629

[45] Date of Patent: Dec. 21, 1999

[54] ROOFERS SAFETY BRACE

[76] Inventors: Robert J. Cloutier, P.O. Box 175, South Londonderry, Vt. 05155; Charles M. Synder, P.O. Box 438; Norman J. Cloutier, Jr., Adams Dr., both of Londonderry, Vt. 05148

[21] Appl. No.: 09/217,298

[22] Filed: Dec. 21, 1998

[51] Int. Cl.[6] ..... E06C 7/48

[52] U.S. Cl. ..... 182/45; 182/113; 248/237

[58] Field of Search ..... 182/45, 113; 248/237

[56] References Cited

U.S. PATENT DOCUMENTS 5,601,154 2/1997 Eisenmenger ..... 182/45
5,624,006 4/1997 Richardson ..... 182/45
5,896,944 4/1999 McMillian ..... 182/45
5,908,083 6/1999 Hamilton ..... 182/45

*Primary Examiner*—Alvin Chin-Shue
*Attorney, Agent, or Firm*—John J. Welch Jr., Esq.

[57] ABSTRACT

A roofer's safety brace unit consisting of a pair of main frame track components, an extension arm, a pivotably attached support arm equipped with a rubberized foot pad at one end thereof and a running wheel at the other end thereof placeable upon a roof by virtue of the function of a plurality of chair shaped lateral support units equipped with rubberized foot pads such as are attached to plank holding brackets affixable to the main frame track components or extension arm, and, one of which brackets is further equipped with a pivotable plank bar such that when a duplicate pair of such safety brace units is utilized by a roofer, planking suitable to safely supporting the weight of a roofer working on a roof is readily and dependably held fast in place.

8 Claims, 12 Drawing Sheets

ROOFERS SAFETY BRACE

B CROSS REFERENCES TO PRIOR OR PARENT APPLICATIONS

Figure 1:
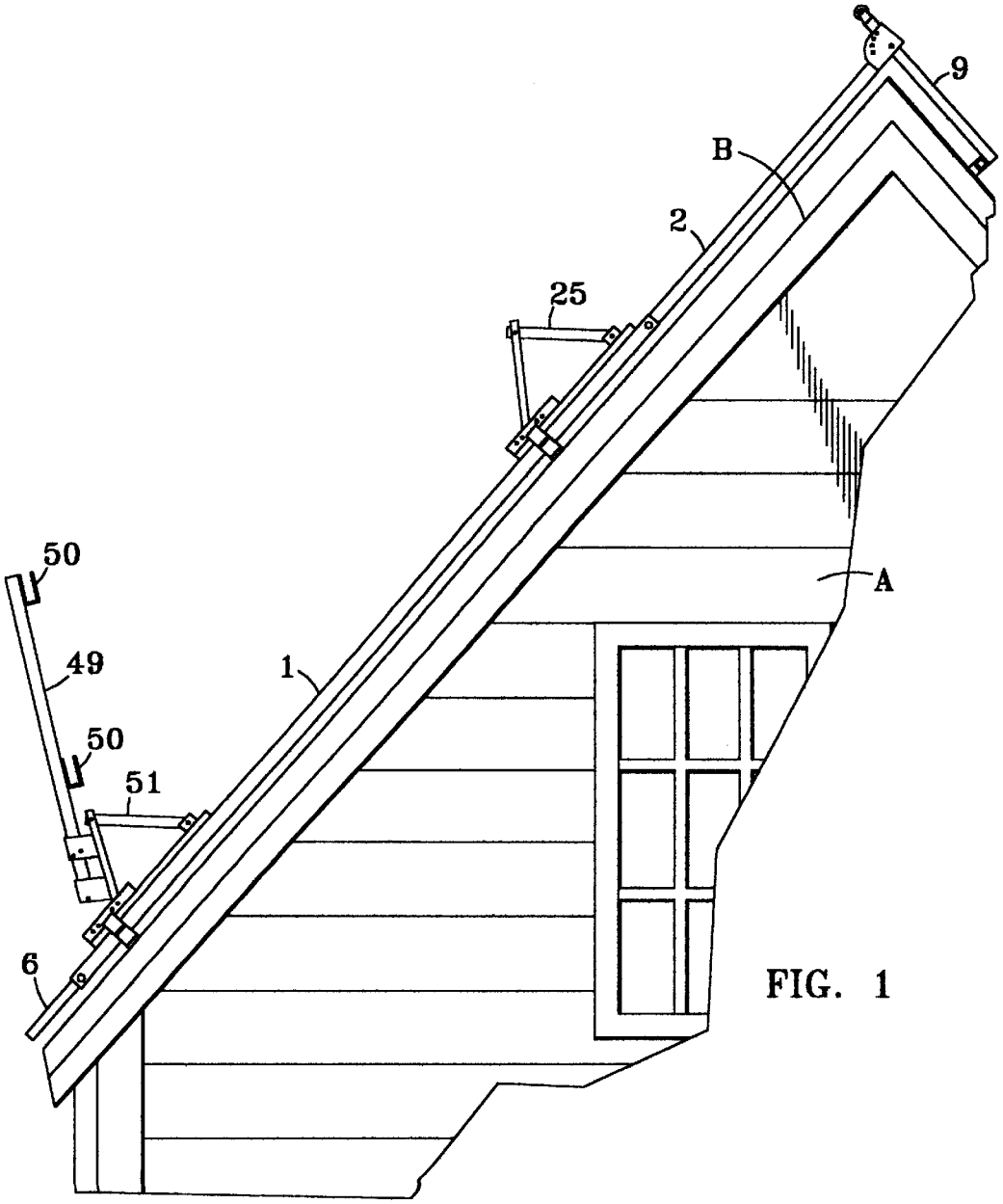

There are no prior or parent applications to which the instant invention relates.

C FEDERALLY SPONSORED RESEARCH AND DEVELOPMENT

There is no federally sponsored research and development associated with the instant invention.

D BACKGROUND OF THE INVENTION

1. Field of the Invention

The instant invention is one that relates to mechanical devices suitable for facilitating the repair and/or maintenance of roofing on buildings.

2. Regarding Possible Prior Art

The art such as is set forth in the Art Statement which accompanies this application does not anticipate the instant invention.

E SUMMARY OF THE INVENTION

1. A Brief Description the Invention

The instant invention is comprised of the following elements. An extension arm fits into a first main frame track arm component at a first end thereof to accommodate working on relatively large pitched roofs. The first main frame track arm which is hollow is affixed at a second end thereof to a hollowed out second main frame track arm component. At one end of the second main frame track arm, a support arm is pivotably attached. The support arm is equipped with a perpendicularly aligned holding foot, one edge of which is fitted with a rubberlike foot pad. At the end of the support arm opposite the end thereof where there is found the holding foot, there is to be found a running wheel affixed thereto. The running wheel allows for quick installation of the invention on a roof. The arms affixed to one another to form one safety brace support unit are run up the roof via the running wheel, and, once over the peak of the roof, the whole unit is turned 180° and is held via the holding foot and support arm upon the side of the peak opposite, to the side to be worked on by roofers. The support arm is secured at an angle corresponding to the pitch of the roof via a pin through one of a group of through holes in corresponding hinge plates adjacent the support arm and affixed to the second main frame track arm. In each track arm are a series of sunken keyhole shaped apertures for removably holding the heads of base support pins of hollow based plank holding brackets that are removably affixed to the track arms. The plank holding brackets are triangularly shaped. Aside of and affixed to each plank holding bracket are a pair of chair-shaped lateral support units each equipped with a rubberized foot serving to hold the invention a short distance above roof shingles thereby facilitating ready access to the shingles much moreso than is the case with respect to other such devices. A specialized plank holding bracket which is likewise removably affixed to the first main frame track arm or extension arm and which is the bracket component of the invention furthest removed from the peak of the roof, has a pivotable plank bar resting therein and pinned thereto and has a pair of chair-shaped lateral support units affixed thereto as well.

The fully intact invention when paired with a duplicate thereof on a roof serves to hold planking at an angle to the surface of the roof suitable to prevent a roofer from ever sliding downwardly on the roof once the feet of the roofer are supported by such planking. The pivotable plank bars of each duplicate unit serve to hold planking as a form of roof's end fencing at an angle in relating to the pitch of the roof suitable to prevent a roofer from falling off from a roof whereupon the instant invention is utilized.

2. Objects of the Invention

One difficulty invariably confronting roofers with regards to other devices serving to facilitate roof maintenance and repair is the need as respects such devices to fasten them, for example, with nails to the roof in need of repair. Such a requirement only serves to invite yet further difficulties as regards leaks and shingle damage. The instant invention unlike any other such devices can be easily utilized without any need whatsoever to fasten it to the roof with nails. This innovation is accomplished by virtue of the components intrinsic to the instant invention namely the chair shaped lateral support units equipped with rubberized foot pads. Moreover, whereas the bracket components of the instant invention are situated atop its track arm components, there is absolutely no possibility of damage to a roof resulting from any need to fasten any brackets to the roof while under repair. Also, the geometrical simplicity of the instant invention allows for quick and ready access to hard to reach roof areas such as areas characterized by the presence of vent pipes in so-called valley locations. Furthermore, whereas the instant invention once positioned does not need to be moved until after the sector of a roof under immediate repair is completely repaired such as is not the case with other such devices, the instant invention thereby permits relatively fast installation and indeed, and this is especially important particularly from an economic vantage point, by only one repair person without a need for two such persons. For example, in view of the chair shaped lateral supports feature of the instant invention, shingles directly under the track arm can be removed and readily replaced by only one person without any need to disturb the positioning of a track arm until such time as a shingle resting under a lateral support unit is in need of repair, and then its a simple matter to merely move the track arm a shingle length away and repair those couple of shingles or so previously under the support units. Finally, the roof end fencing capability coupled with a bracket predicated plank holding capability of the instant invention serves to greatly enhance the safety concerns that are always within the mind's eye of any repair person.

Respectfully submitted, for the foregoing reasons, the instant invention is indeed new, unique and unquestionably useful as being virtually revolutionary in the field of roofing maintenance and repair.

F A DESCRIPTION OF THE DRAWINGS

1. FIG. 1 is a cutaway frontal plan view of the instant invention situated upon the roof of a building.

Figure 2:
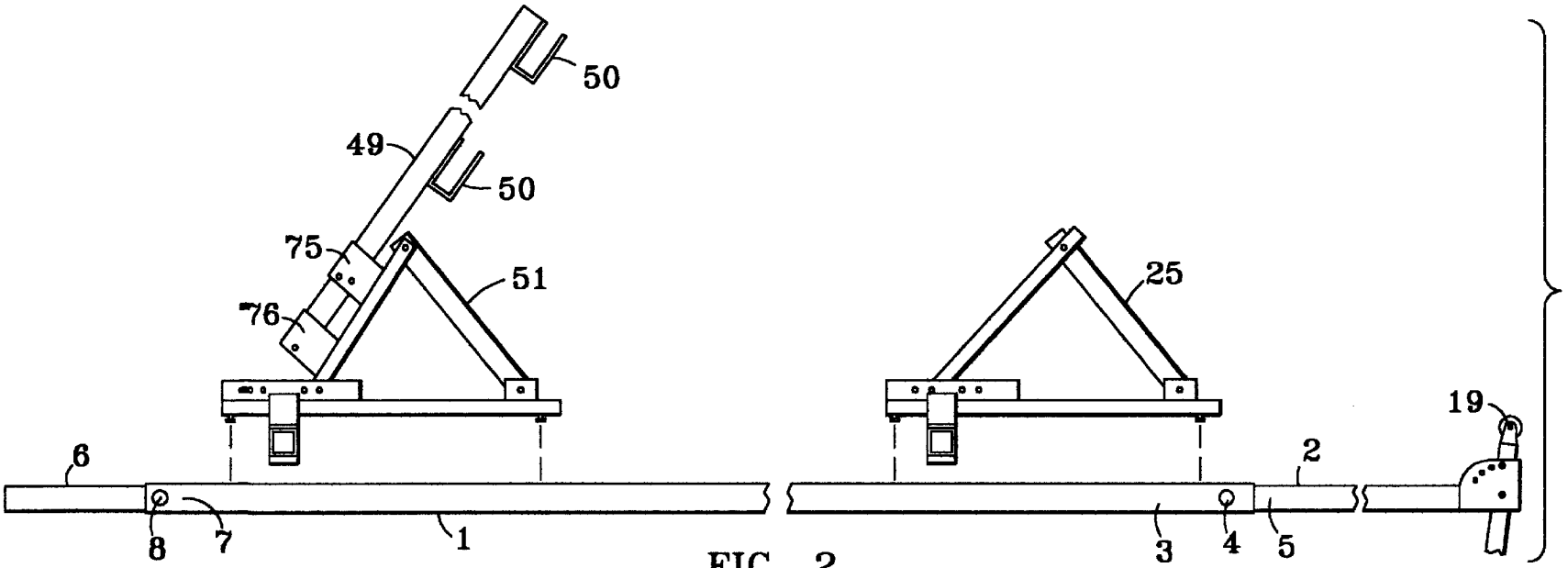

2. FIG. 2 is a broken lateral plan view of the instant invention.

Figure 3:
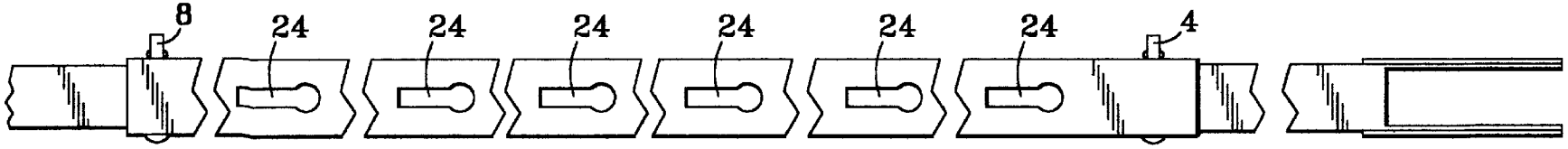

3. FIG. 3 is a broken top plan view of the first main frame track arm component of the instant invention.

Figure 4:
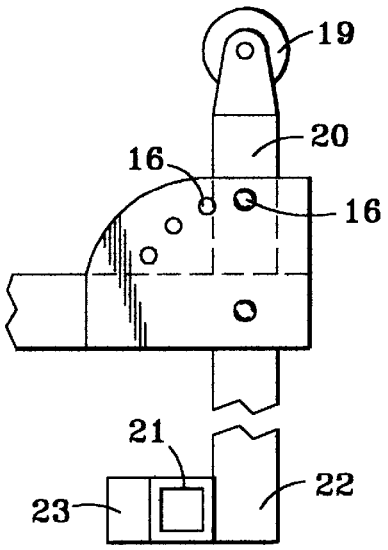

4. FIG. 4 is a broken lateral plan view of the pivotably attached support arm and running wheel component of the instant invention.

Figure 5:
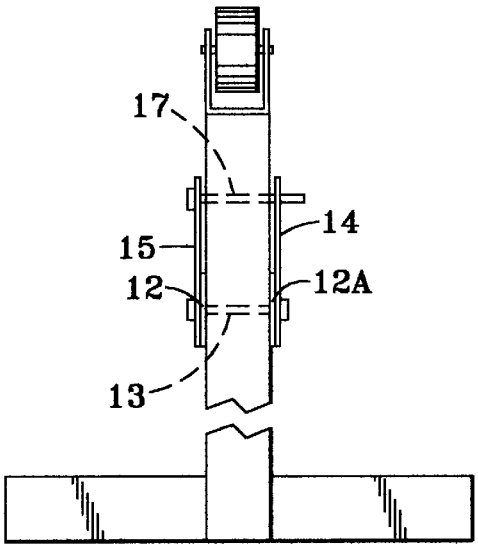

5. FIG. 5 is a top plan view of those components featured in FIG. 4.

Figure 6:
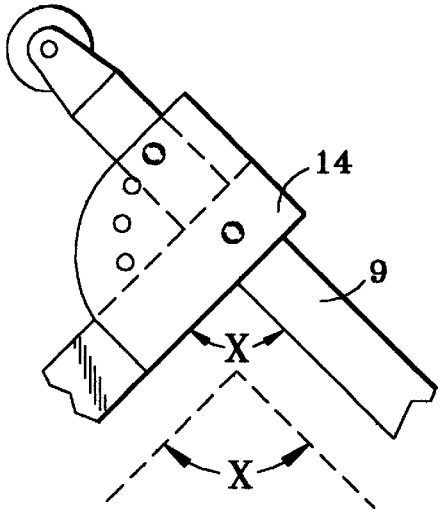

6. FIG. 6 demonstrates pivotability of those components featured in FIG. 4 through an angle x.

Figure 7:
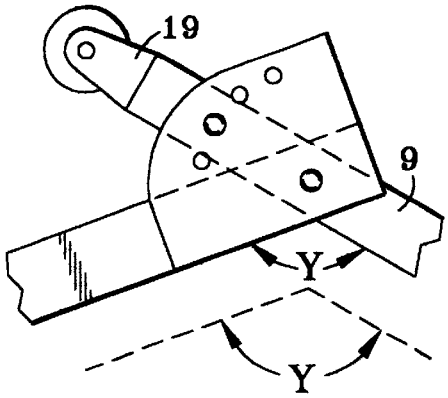

7. FIG. 7 demonstrates pivotability of those components featured in FIG. 4 through an angle y.

Figure 8:
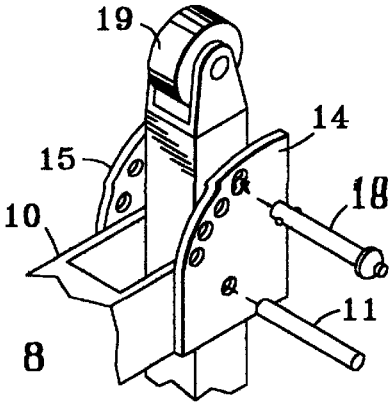

8. FIG. 8 illustrates pin holding means for holding a support arm at a desired angle in relation to a second mainframe track component.

Figure 9:
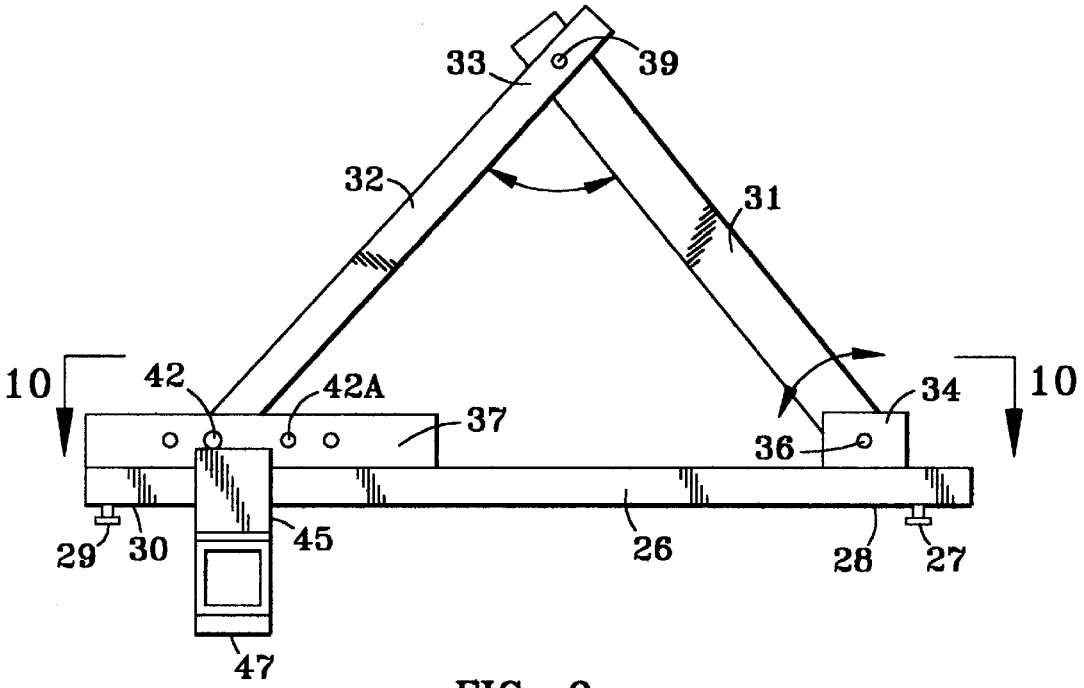

9. FIG. 9 is a lateral plan view of a plank holding bracket component of the instant invention.

Figure 10:
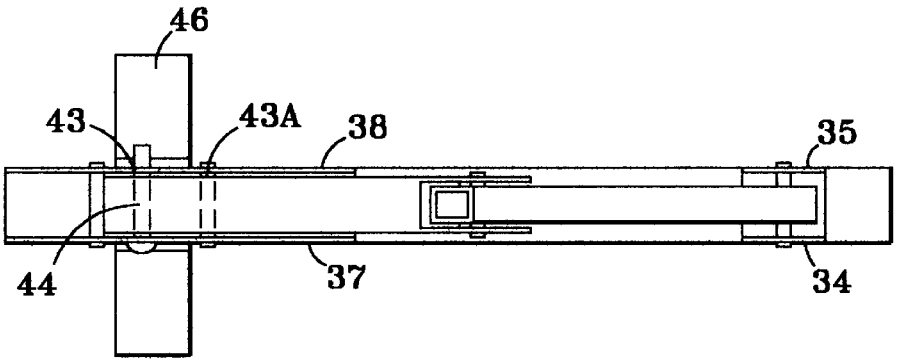

10. FIG. 10 is a top plan view of a plank holding bracket component of the instant invention.

Figure 11:
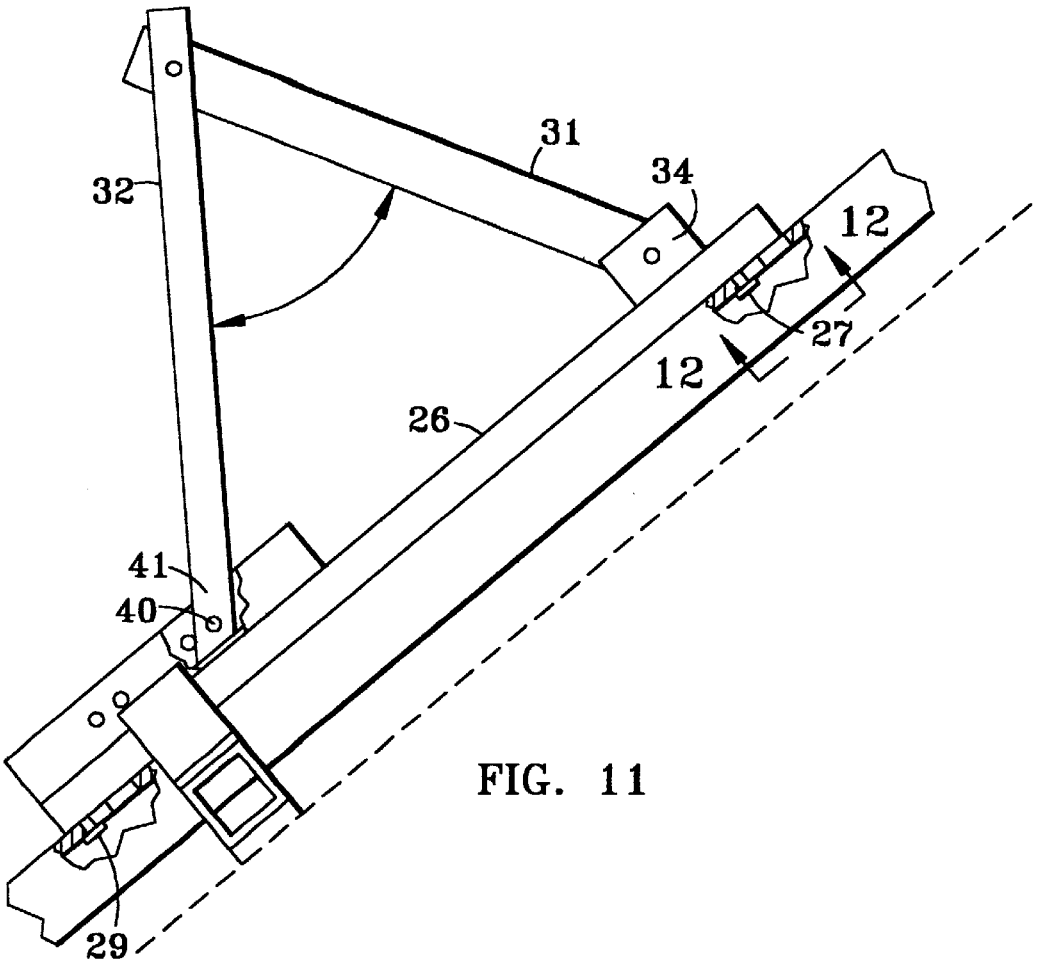

11. FIG. 11 is a broken frontal plan view of a plank holding bracket component shown attached to a track arm component.

Figure 12:
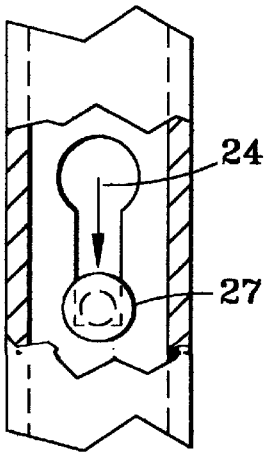

12. FIG. 12 is an isolated top plan view of a key hole shaped aperture in the top side of a track arm component shown holding a base holding pin of a plank holding bracket component in a locked position.

Figure 13:
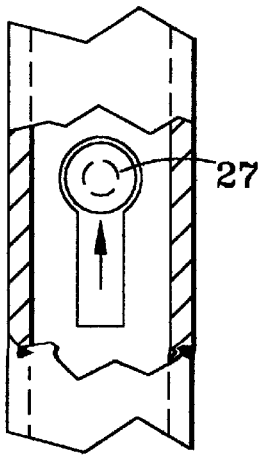

13. FIG. 13 is an isolated top plan view of a key hole shaped aperture in the top side of a track arm component shown holding a base holding pin of a plank holding bracket component in an unlocked position.

Figure 14:
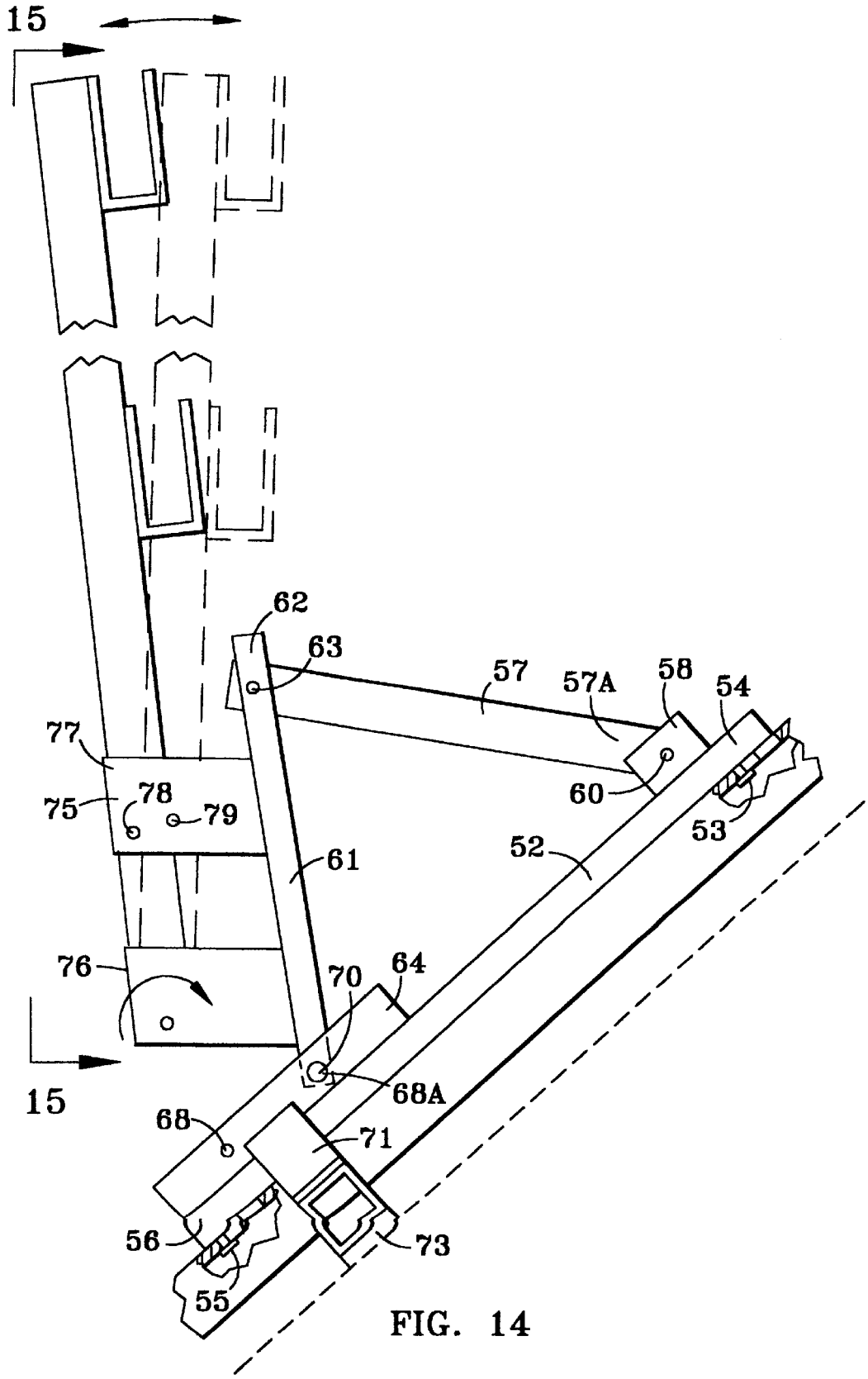

14. FIG. 14 illustrates the pivotable adaptability to the pitch of a roof of the plank bar component of the instant invention.

Figure 15:
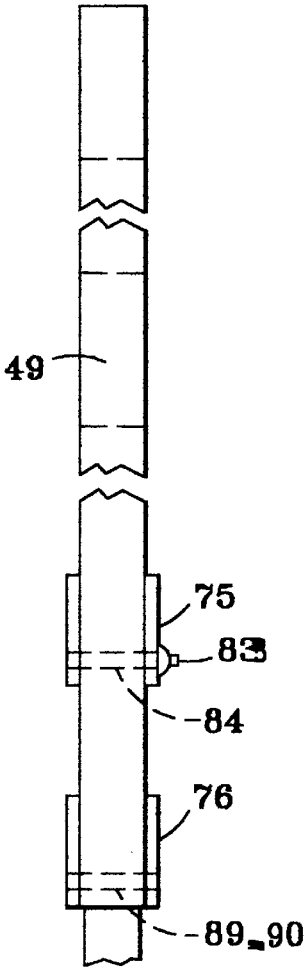

15. FIG. 15 is a broken rear plan view of the plank bar component of the instant invention.

Figure 16:
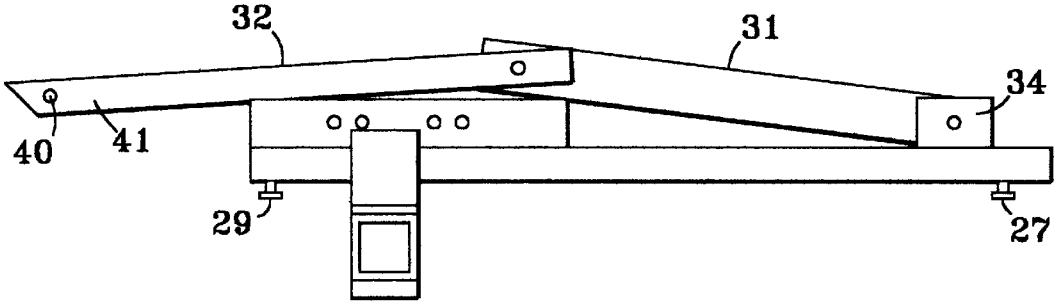

16. FIG. 16 illustrates the foldability of a plank holding bracket.

Figure 17:
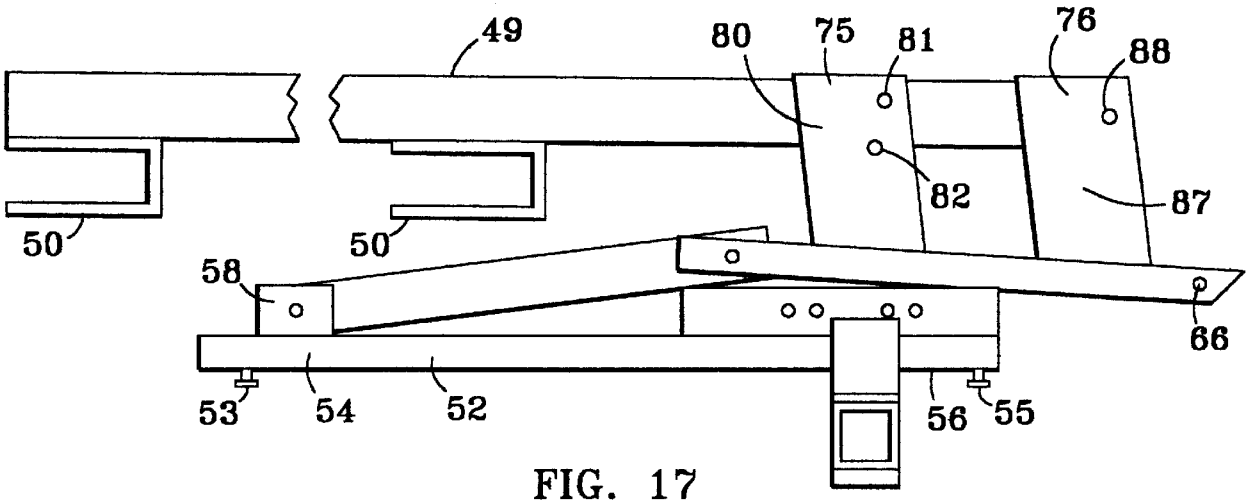

17. FIG. 17 illustrates the foldability of a plank holding bracket component equipped with a plank bar component.

Figure 18:
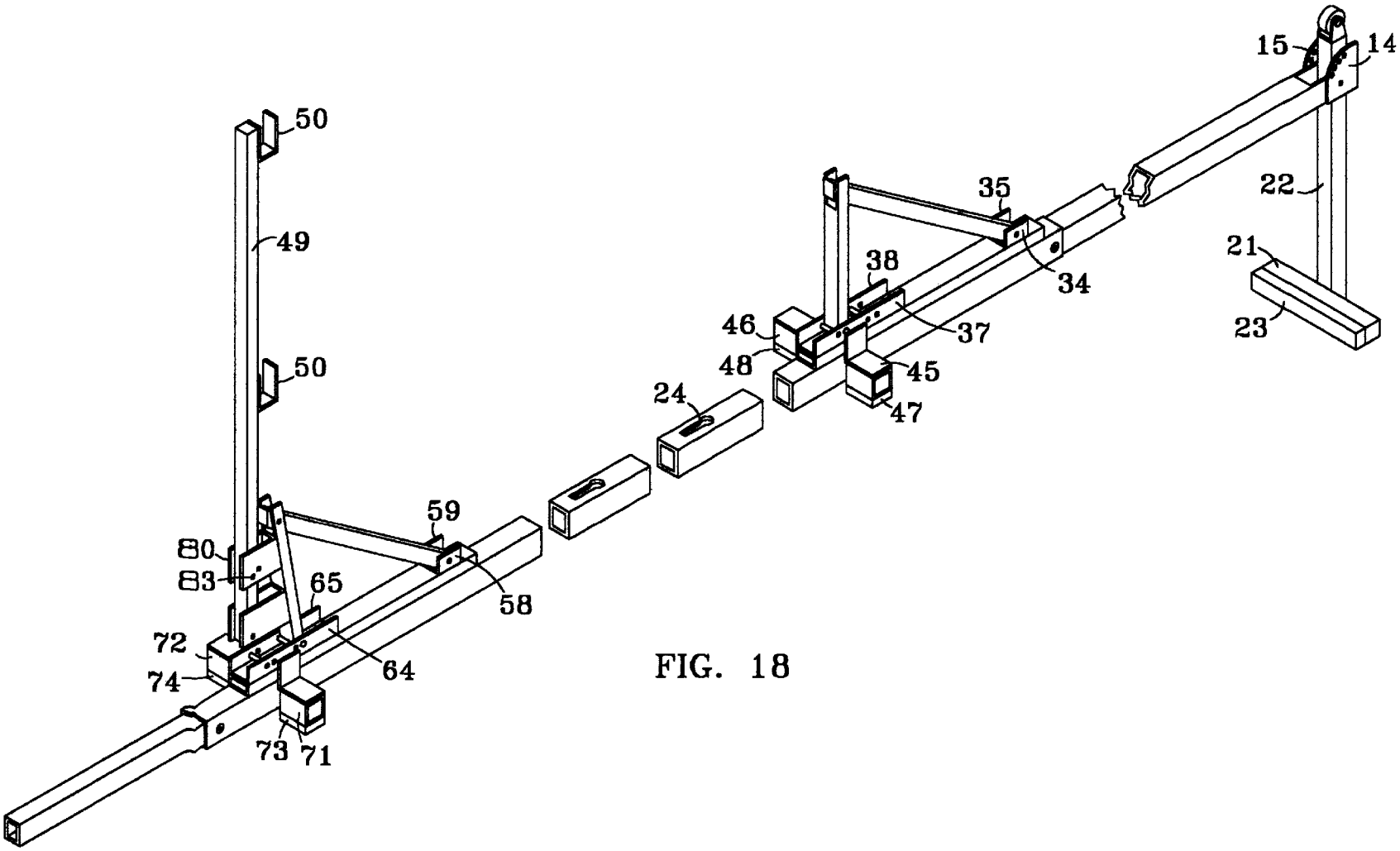

18. FIG. 18 is an isolated perspective view of the intact instant invention.

Figure 19:
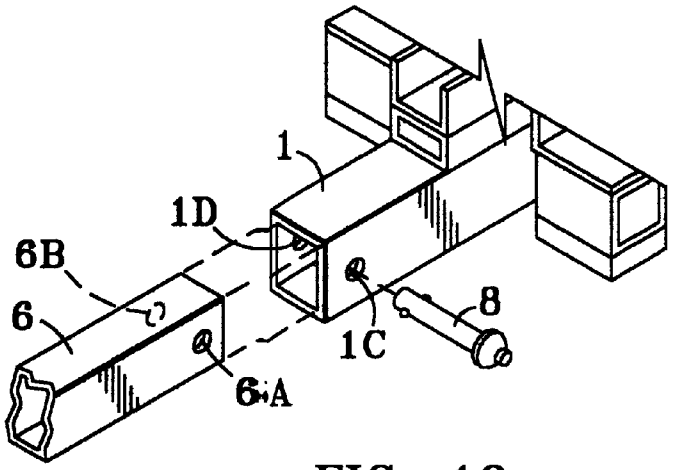

19. FIG. 19 illustrates in isolated perspective view, the affixability of an extension arm component to the first main frame track arm component of the instant invention.

Figure 20:
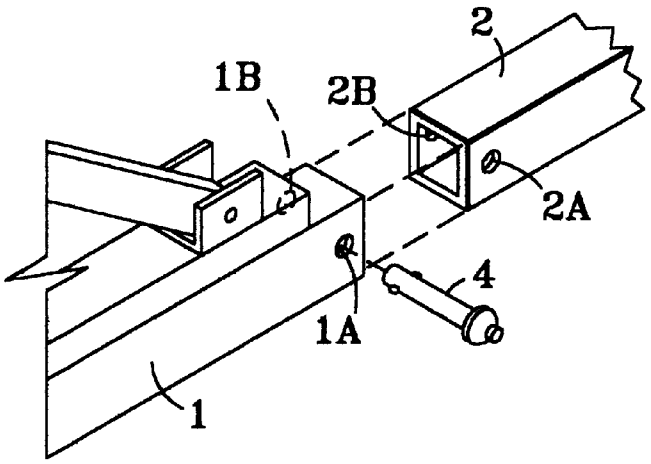

20. FIG. 20 illustrates in isolated perspective view, the affixability of a first main frame track component to a second main frame track arm component of the instant invention.

Figure 21:
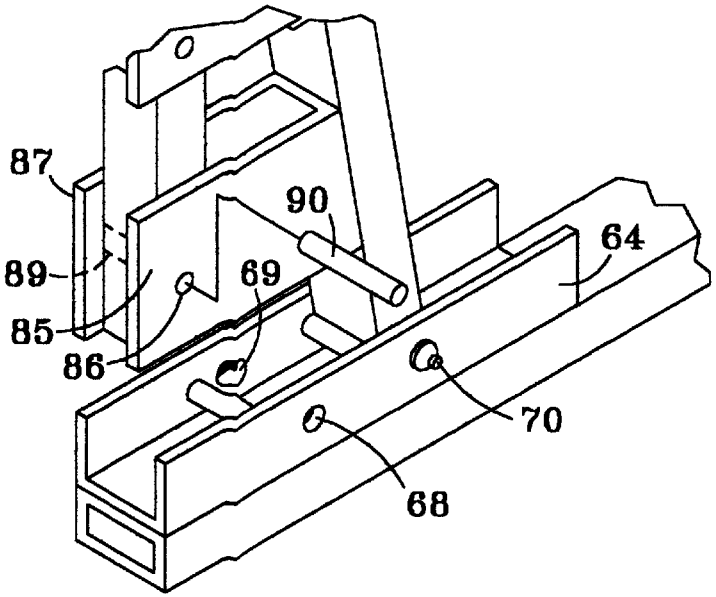

21. FIG. 21 illustrates in isolated perspective view the manner of assembly of the bracket shown in FIG. 14 in respect of holding plank at an angle amenable to the pitch of a given roof.

Figure 22:
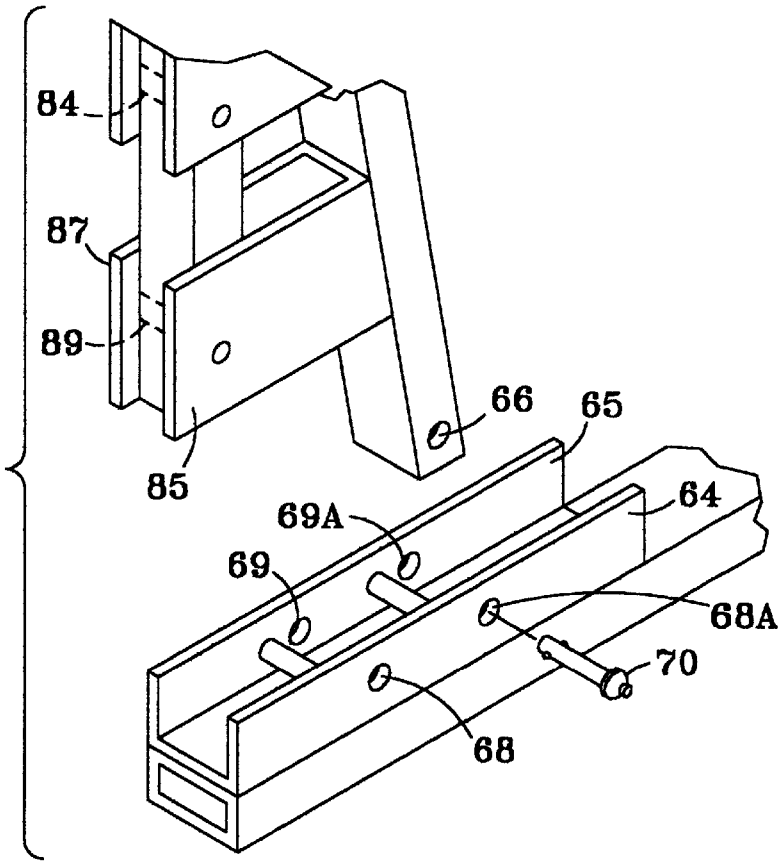

22. FIG. 22 illustrates disassembly what is seen in FIG. 21.

Figure 23:
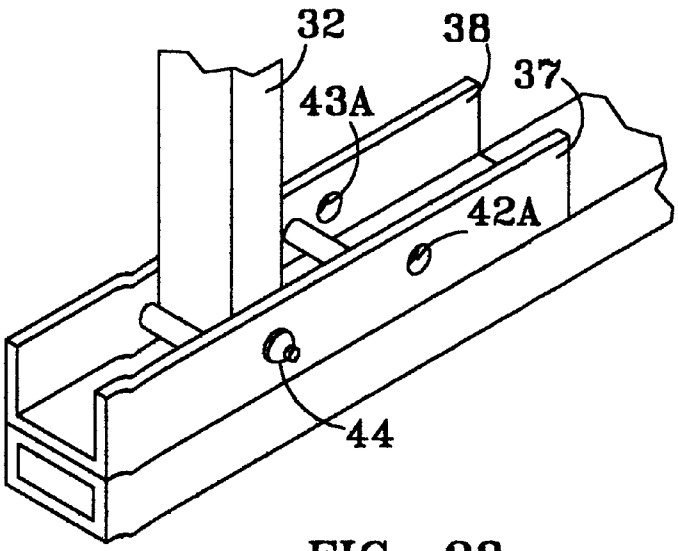

23. FIG. 23 illustrates in isolated perspective view the manner of assembly of the bracket shown in FIG. 9 in respect of holding planking at an angle amenable to the pitch of a given roof.

Figure 24:
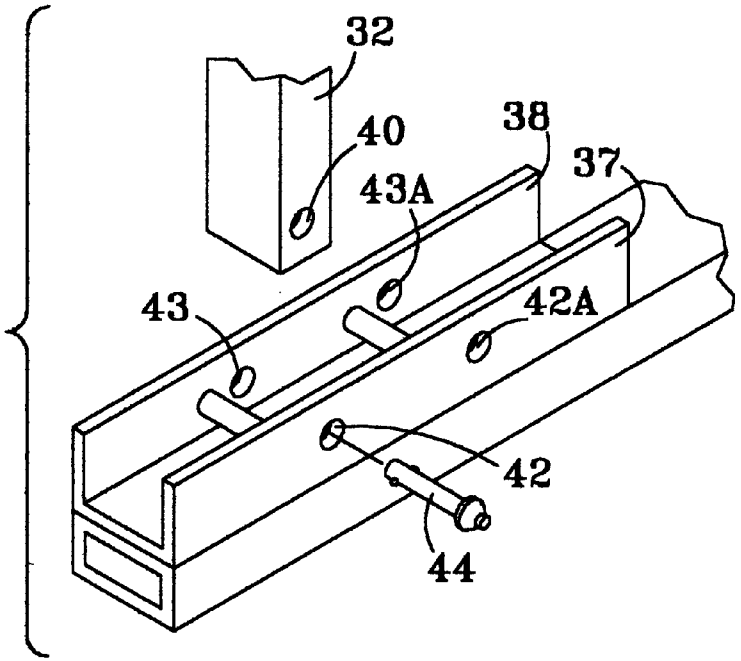

24. FIG. 24 illustrates reassembly of what is seen in FIG. 23.

Figure 25:
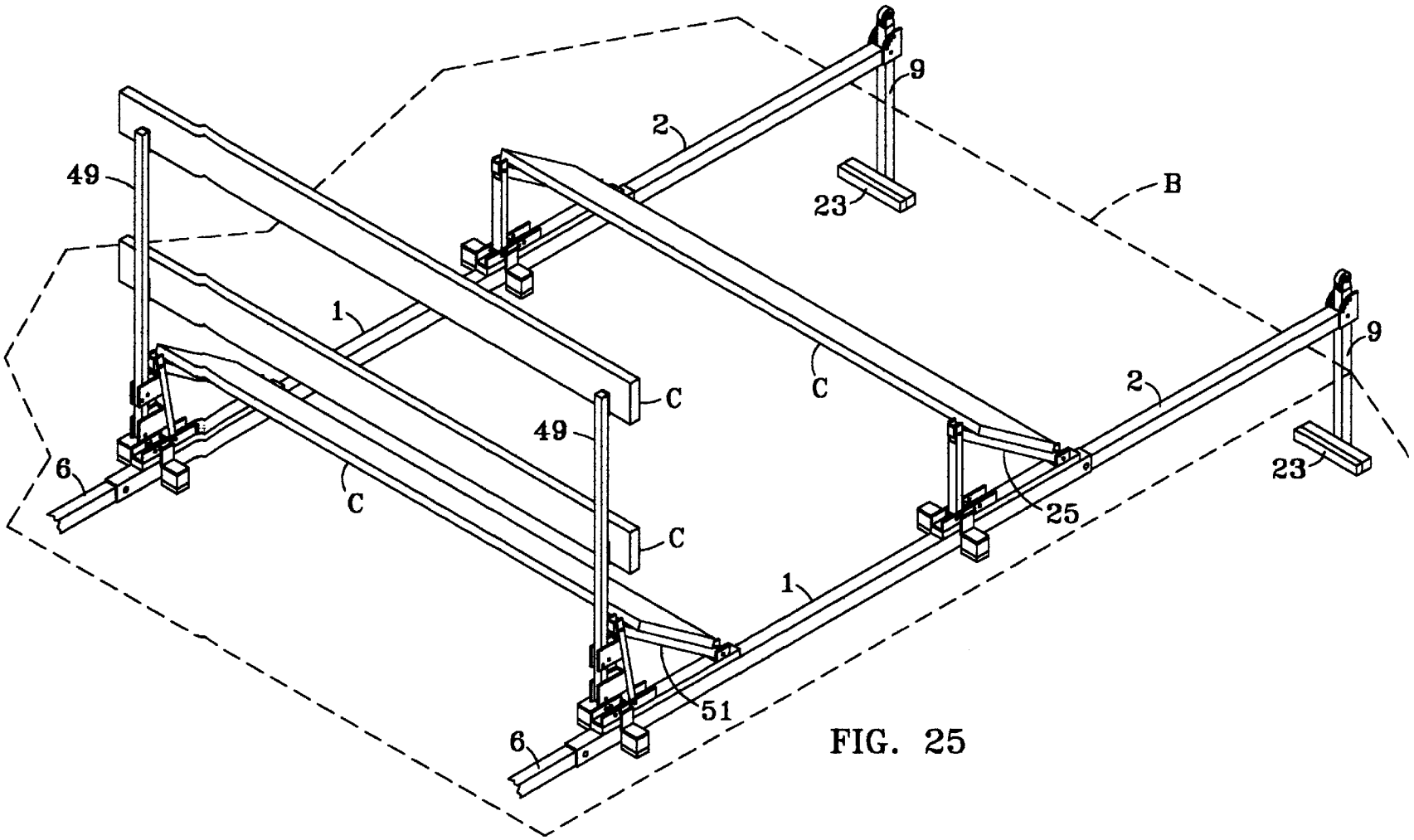

25. FIG. 25 illustrates two duplicates of the instant invention holding planking atop a schematically depicted roof.

G A DESCRIPTION OF THE PREFERRED EMBODIMENTS

FIG. 1 illustrates the manner in which the intact invention is filled to a roof B of a building A in need of shingling or repair. FIG. 25 illustrates the manner in which planking C is held by a pair of duplicate units of the instant invention fitted to a roof B therein depicted schematically by dotted lines. The planking C is a form of safety fencing to prevent a roofer from falling from a roof being shingled or repaired all as can be noted with resort to FIG. 25. FIG. 2 evidences the essential components of the invention. A hollow second main frame track arm 2 at a first end 5 thereof is therein shown affixed to a second end 3 of a hollow first main frame track arm component 1 and an extension arm component 6 is therein shown affixed at first end 7 of first main frame track arm 1. First pin holding means 4 insertable through through holes 1A and 1B in track arm 1 and through holes 2A and 2B in track arm 2 as particularly depicted in FIG. 20 for affixing arm 1 to arm 2 are therein shown as well. Likewise second pin holding means 8 insertable through through holes 1C and 1D in track arm 1 and through through holes 6A and 6B in extension arm component 6 as particularly depicted in FIG. 19 for affixing arm 6 to arm 1 are also depicted. In the vicinity of a second end 10 of arm 2 there is to be found as therein depicted a support arm 9 pivotably connected to second main frame track arm 2 by a third pin holding means 11 seen in FIG. 8 through a corresponding pair of second end track arm through holes 12 and 12A and a first support arm through hole 13 as seen in FIG. 5. A duplicate pair of hinge plates 14 and 15 seen in FIG. 8 are attached to track arm component 2 in the vicinity of second end 10 thereof and FIGS. 4, 5, 6 and 7 also serve to demonstrate such affixation. A plurality of through holes 16 in each of hinge plates 14 and 15 as seen in FIG. 4 enable the instant invention to be held over the peak of a roof B to the roof by way of fourth pin holding means 18 seen in FIG. 8 insertable through one of the plurality of through holes 16 in each of hinge plates 14 and 15 and in turn through a concomitant support arm through hole 17 coincident in location with corresponding through holes 16 in hinge plates 14 and 15. As can be noted with resort to FIG. 8, removable fourth pin holding means 18 can be inserted into different corresponding through holes 16 in hinge plates 14 and 15 in order to accommodate a holding of the instant invention over the peaks of roofs of different pitches, for example per FIG. 6, a roof pitch serving to produce an angle x at the peak of the roof or per FIG. 7, one serving to produce thereat an angle y. Initially, the instant invention is rolled up the surface of a roof B on running wheel 19 up over the peak of the roof B and then turned through an angle of 180° and just previously to so rolling it up the incline of roof B, fourth pin holding means 18 would have been inserted through holes 16 in plates 14 and 15 and hole 17 so as to accommodate ultimately the particular pitch of the roof B to be worked on. Once rolled up and over the peak of roof B, the invention, as earlier mentioned is rotated through an angle of 180° so that a holding foot component 21 seen in FIGS. 1 and 4 attached to support arm 9 at a second end 22 thereof opposite the first end 20 thereof to which running wheel 19 is attached all as seen in FIGS. 4 and 8 can operate to firmly, grip, as it does, the surface of roof B on the opposite side of the peak of the roof as appreciated with resort to FIGS. 1 and 25 via a rubbery, tacky foot pad 23 attached to holding foot component 21. Keyhole shaped apertures 24 as seen in FIG. 3 found in a top side of track arms 1 and 2 and extension arm 6 serve to receive base pins 27 and 29 of a triangularly shaped plank holding bracket 25 such as is depicted in FIGS. 2 and 9. FIGS. 12 and 13 illustrate the base pins 27 and 29 slideably insertable within keyhole apertures 24 in the locked and unlocked positions respectively. In the locked position, plank holding bracket 25 is held fast to a track arm 1 or 2. FIGS. 9 and 10 depict in lateral plan view and top plan view respectively, plank holding bracket 25, and in FIG. 11, base pins 27 and 29 are shown held in locked position within respective keyhole apertures 24. Base pins 27 and 29 are located on a bottom side of a first base leg member 26 of plank holding bracket 25 seen in FIG. 9. A first leg member 31 of plank holding bracket 25 is pivotably affixed at a first end thereof near a first end 28 of base leg member 26 to base leg member 26 by way of fifth pin holding means 36 inserted through holes in leg 31 and in each of a pair of base leg hinge plates 34 and 35 thereat attached to first base leg member 26 as seen in FIG. 9 as well as being pivotably affixed by way of sixth pin holding means 39 at a second end of member 31 to a first end 33 of second leg member 32 of plank holding bracket 25 as seen in FIG. 9. A first duplicate pair of holding plate members 37 and 38 are affixed to the lateral sides, one plate per side, of first base leg member 26 at a second end 30 thereof. A duplicate pair of through holes 42, 42A and 43, 43A are respectively located in each of holding plate members 37 and 38 as seen in FIGS. 9 and 10. A plate holding seventh pin holding means 44 insertable through one of the pair of through holes 42 or 42A in plate member 37 and through a corresponding one of the pair 43 or 43A in plate member 38 serves to hold second leg member 32 through second leg through hole 40 near a second end 41 of member 32 as seen in FIGS. 11 and 16 at a desired angle with reference to first base leg member 26 such that planking C can be held at an angle relative to the pitch of roof B sufficient to support the soles of the boots of a roofer on one or both knees working atop roof B with the soles of his or her shoes resting against held planking C. Seventh pin holding means 44 inserted through the anteriorly positioned ones of holes 42, 43 and 42A, 43A in plates 37 and 38 respectively and through hole 40 serve to enable support of planking C at an angle with reference to the pitch of one type of roof with one particular grade of pitch just as effectively as insertion of seventh pin holding means 44 through the posteriorly positioned ones of through holes 42, 42A and 43, 43A in plates 37 and 38 and through hole 40 will enable support of planking C at an angle with reference to the pitch of another roof with a different grade of pitch. A first duplicate pair of chair shaped lateral support units 45 and 46 with each being attached respectively to an outer portion of one lateral side of first base leg member 26 and one of plates 37 and 38 and with each having a rubbery, tacky foot pad 47 and 48 respectively attached to a bottom side of each, serve to hold track arm 1 or 2, as the case may be, depending on whether base pins 27 and 29 are inserted into keyhole apertures 24 in track arm 1 or 2, above the level of roof B so that only pads 47 and 48 touch the surface of roof B. FIGS. 1 and 18 demonstrate this feature of the invention. A plank bar 49 is seen in FIG. 1 and FIG. 18 as are a plurality of three sided plank holding groove members 50 frontally affixed thereto. Plank bar 49 shown in rear plan view in FIG. 15 is pivotably affixed as can be noted with resort to FIG. 14 to a lowest one 76 of a pair of three sided plank bar holding members 75 and 76 each in turn affixed to a posterior side of a second leg member 61 of a triangularly shaped second plank holding bracket component 51 as seen in FIG. 14. Such affixation of plank bar 49 is by way of twelfth pin holding means 90 insertable through a through hole 86 in a first lateral side 85 of holding member 76, a base through hole 89 in plank bar 49 and a through hole 88 in a second lateral side 87 of holding member 76 as can be particularly noted in FIG. 21. Holding members 75 and 76 could alternatively consist of a pair of plates each perpendicularly welded to a posterior side of leg member 61 with each one of such plates being characterized by the presence of through holes equivalent to holes 86 and 88 in each of a lower pair, one hole per member and as respects a higher pair, two through holes per member thereof equivalent to holes 78, 81, 79 and 82 as seen and appreciated with resort to FIGS. 14 and 17. Bracket component 51 as seen i.e., in FIGS. 1 and 14; consists of a base leg member 52 to which there are attached to a bottom side thereof, a third base pin 53 near a first end 54 thereof and a fourth base pin 55 near a second end 56 thereof. A first leg member 57 of bracket component 51 is pivotably affixed by way of eighth pin holding means 60 located at a first end 57A thereof to a second duplicate pair of base leg hinge plates 58 and 59 in turn attached to base leg member 52 near first end 54 thereof; and again pivotably affixed at a second end 57B thereof to a second leg member 61 of bracket component 51 near a first end 62 thereof as seen in FIG. 14 by way of ninth pin holding means 63. A second duplicate pair of holding plate members 64 and 65 are affixed to the lateral sides, one plate per side, of base leg member 52. A duplicate pair of through holes 68 and 68A and 69 and 69A are respectively located in each of holding plate members 64 and 65 as seen in FIGS. 14 and 21. A plate holding tenth pin holding means 70 insertable through one of the pair of through holes 68 and 68A in plate member 64 and through a corresponding one of the pair of through holes 69 and 69A in plate member 65 serves to hold second leg member 61 through second leg through hole 66 seen in FIG. 17 and FIG. 22 at a desired angle with reference to first leg member 57 such that planking C can be held at an angle relative to the pitch of roof B sufficient to support the soles of the boots of a roofer on one or both knees working atop roof B with the soles of his or her shoes resting against held planking C. Tenth pin holding means 70 inserted through the anteriorly positioned ones of holes 68, 68A and 69, 69A in plates 64 and 65 and through hole 66 serve to enable support of planking C at an angle with reference to the pitch of one type of roof with one particular grade of pitch just as effectively as insertion of tenth pin holding means 70 through the posteriorly positioned ones of through holes 68, 68A, 69 and 69A in plates 64 and 65 and through hole 66 will support planking C at an angle with reference to the pitch of another roof with a different grade of pitch. A second duplicate pair of chair shaped lateral support units 71 and 72 with each being attached respectively to an outer portion of one lateral side of first leg member 57 and one of plates 64 and 65 and with each having a rubbery, tacky foot pad 73 and 74 respectively affixed to a bottom side of each, serve to hold track arm 1 or extension arm 6, as the case may be, depending on whether base pins 53 and 55 are inserted into keyhole apertures 24 in track arm 1 or in extension arm 6 above the level of roof B so that only pads 73 and 74 touch the surface of roof B. FIGS. 14 and 18 serve to demonstrate this feature of the invention. Plank bar 49 is adjustable to accommodate the pitch of a given roof by way of eleventh pin holding means 83 insertable through corresponding through holes 78 and 81 or 79 and 82 respectively in a first lateral side 77 and a second lateral side 80 of a highest one 75 of the abovementioned pair of plank bar holding members as well as through a superior through hole 84 in plank bar 49 as are seen and appreciated with resort to FIGS. 14, 17 and 22. Another variation of the instant invention would be characterized by a lack of a through hole 84 and with pinning merely occurring anteriorly to the locus of plank bar 49 in relation to the loci of holes 78, 81 or 79 and 82 respectively. Such adjustment capability provides for eminently suitable safety fencing available to roofers on a roof B of a given pitch so a to thereby protect them from any possible falls from the roof to the ground. FIGS. 16 and 17 illustrate in lateral plan view, the foldability of bracket component 25 and bracket component 51 respectively. FIG. 18 is a perspective exploded view of the intact invention FIGS. 19 and 20 respectively illustrate the manner in which extension arm 6 is held to track arm 1 and in which track arm 1 is held to track arm 2 upon assembly of the intact instant invention. FIG. 23 along with FIG. 24, illustrate the manner in which second leg member 32 via second leg through hole 40 is held via seventh pin holding means 44 insertable through one of the pair of through holes 42 and 42A in plate member 37 and a corresponding one of the pairs of through holes 43 and 43A in plate member 38. FIG. 21 along with FIG. 22 markedly illustrate the manner in which second leg member 61 via second leg member through hole 66 is held via a tenth pin holding means 70 insertable through one of the pair of through holes 68 and 68A in plate member 64 and a corresponding one of the pair of through holes 69 and 69A in plate member 65. FIG. 25 serves to panoramically illustrate how a duplicate pair of intact invention units operate to serve the safety and work efficacy interests of a roofer working to repair or maintain a roof B. Also, all of the above mentioned pin holding means could be replaced with other holding means such as, for example, flexible sturdy wiring.

In conclusion, in view of the foregoing, it is respectfully submitted that the instant invention is not only new, useful and unique but is, indeed, virtually revolutionary in the art of devices amenable to facilitating any sought-to-be safe and efficient undertaking to repair and/or maintain roofing on a building.

What is claimed is:

1. A roofer's safety brace, comprising:

a. a hollow first main frame track arm;

b. a hollow second main frame track arm;

c. first pin holding means insertable through through holes in said hollow first main frame track arm and through through holes in said hollow second main frame track arm for affixing said first main frame track arm at a second end thereof to said hollow second main frame track arm at a first end thereof;

d. an extension arm component insertable into a first end of said hollow first main frame track arm;

e. second pin holding means insertable through additional through holes in said hollow first main frame track arm and through additional through holes in said extension arm component for affixing said extension arm component into said first end of said hollow first main frame track arm;

f. a support arm component pivotably affixed, by way of third pin holding means insertable through a corresponding pair of second end track arm through holes and a first support arm through hole, to said hollow second main frame track arm near a second end of said hollow second main frame track arm;

g. a duplicate pair of hinge plates affixed to said second end of said second main frame track arm;

h. a plurality of through holes in each of said duplicate pair of hinge plates;

i. a second support arm through hole;

j. removable fourth pin holding means for holding said support arm component fixed at an angle to said hollow second main frame track arm insertable through one of said plurality of through holes in one of said hinge plates through said second support arm through hole and through one of said plurality of through holes in an other one of said hinge plates;

k. a running wheel component affixed to a first end of said support arm;

l. a holding foot component affixed to a second end of said support arm and perpendicularly aligned with said support arm;

m. a rubbery, tacky foot pad affixed to said holding foot component;

n. a plurality of keyhole shaped apertures in a top side of said first main frame track arm, in a top side of said second main frame track arm and in a top side of said extension arm component;

o. a first triangularly shaped plank holding bracket component;

p. a three sided first base leg member of said first triangularly shaped plank holding bracket component;

q. a first base pin affixed to a bottom side of said first base leg member near a first end of said first base leg member;

r. a second base pin affixed to said bottom side of said first base leg member near a second end of said first base leg member;

s. said first base pin and said second base pin being slideably insertable, one each into any of said keyhole shaped apertures;

t. a first leg member of said first plank holding bracket pivotably affixed to a duplicate pair of first base leg hinge plates by way of fifth pin holding means each of which said duplicate pair of first base leg hinge plates are in turn attached to a top side of said first base leg member near said first end of said first triangularly shaped base leg member;

u. a second leg member of said first plank holding bracket pivotably affixed at a first end thereof by way of sixth pin holding means to said first leg member of said first plank holding bracket;

v. a first triangularly shaped duplicate pair of holding plates affixed, one each to each one of a pair of lateral sides of said first triangularly shaped base leg member near said second end of said first base leg member;

w. a through hole in said second leg member near a second end thereof;

x. a duplicate pair of through holes in each of said first duplicate pair of holding plates;

y. seventh pin holding means insertable through one through hole of said pair of through holes in a first one of said first duplicate pair of holding plates, through said through hole in said second leg member and through a corresponding through hole of said duplicate pair of through holes in a second one of said first duplicate pair of holding plates;

z. a first duplicate pair of chair shaped lateral support units, one of said first duplicate pair of chair shaped lateral support units being attached to an outer portion of a first one of said pair of lateral sides of said first base leg member and to an outer portion of one of said first duplicate pair of holding plates and the other of said first duplicate pair of chair shaped lateral support units being attached to an outer portion of a second one of said pair of lateral sides of said first base leg member and to an outer portion of a second one of said first duplicate pair of holding plates;

aa. a rubbery, tacky foot pad attached to a bottom side of each member of said first duplicate pair of chair shaped lateral support units;

bb. a plank bar;

cc. a plurality of three sided plank holding groove members affixed to a frontal side of said plank bar;

dd. a second triangularly shaped plank holding bracket component;

ee. a base leg member of said second triangularly shaped plank holding bracket component;

ff. a third base pin affixed to a bottom side of said base leg member near a first end of said base leg member;

gg. a fourth base pin affixed to said bottom side of said base leg member near a second end of said base leg member;

hh. said third base pin and said fourth base pin being slideably insertable, one each into any of said keyhole shaped apertures;

ii. a first leg member of said second triangularly shaped plank holding bracket component being pivotably affixed to a second duplicate pair of base leg hinge plates by way of eighth pin holding means, each of which said second duplicate pair of base leg hinge plates are in turn attached to said first base leg member near said first end of said first base leg member;

jj. a second leg member of said second triangularly shaped plank holding bracket component pivotably affixed at a first end thereof by way of ninth pin holding means to said first leg member of said second triangularly shaped plank holding bracket component;

kk. a second duplicate pair of holding plates affixed, one each to each one of a pair of lateral sides of said base leg member near said second end of said base leg member;

ll. a through hole in said second triangularly shaped leg member of said second plank holding bracket component near a second end thereof;

mm. a second duplicate pair of through holes in each of said second duplicate pair of holding plates;

nn. tenth pin holding means insertable through one through hole of said pair of through holes in a first one of said second duplicate pair of holding plates, through said through hole in said second leg member and through a corresponding through hole of one of said duplicate pair of through holes in a second one of said second duplicate pair of holding plates;

oo. a second duplicate pair of chair shaped lateral support units, one of said second duplicate pair of chair shaped lateral support units being attached to an outer portion of a first one of said pair of lateral sides of said base leg member and to an outer portion of one of said second duplicate pair of holding plates and the other of said second duplicate pair of chair shaped lateral support units being attached to an outer portion of a second one of said pair of lateral sides of said base leg member and to an outer portion of a second one of said second duplicate pair of holding plates;

pp. a rubbery, tacky foot pad attached to a bottom side of each member of said second duplicate pair of chair-shaped lateral support units;

qq. a pair of three sided plank bar holding members affixed to a back side of said second leg member of said second triangularly shaped plank holding bracket component;

rr. said plank bar being pivotably affixed to a lowest one of said pair of three sided plank bar holding members;

ss. a first lateral side of a highest one of said pair of three sided plank bar holding members having a first pair of holding member through holes;

tt. a second lateral side of said highest one of said three sided pair of plank bar holding members having a second pair of holding member through holes corresponding to said first pair of holding member through holes;

uu. eleventh pin holding means insertable through one of said first pair of holding member through holes in said first lateral side of said highest one of said pair of plank bar holding members and through a corresponding one of said second pair of holding member through holes in said second lateral side of said highest one of said pair of plank bar holding members;

vv. a first lateral side of said lowest one of said pair of three sided plank bar holding members having a first through hole in it;

ww. a second lateral side of said lowest one of said pair of three sided plank bar holding members having a second through hole in it;

xx. a base through hole in said plank bar, and;

yy. twelfth pin holding means insertable through said first through hole in said first lateral side of said lowest one of said pair of three sided plank bar holding members, said base through hole and second through hole in said second lateral side of said lowest one of said pair of three sided plank bar holding members.

2. A roofer's safety brace, comprising:

a. a hollow first main frame track arm;

b. a hollow second main frame track arm;

c. first holding means insertable through through holes in said hollow first main frame track arm and through through holes in said hollow second main frame track arm at a first end for affixing said first main frame track arm at a second end thereof to said hollow second main frame track arm at a first end thereof;

d. an extension arm component insertable into a first end of said hollow first main frame track arm;

e. second holding means insertable through additional through holes in said hollow first main frame track arm and through additional through holes in said extension arm component for affixing said extension arm component into said first end of said hollow first main frame track arm;

f. a support arm component pivotably affixed, by way of third holding means insertable through a corresponding pair of second end track arm through holes and a first support arm through hole, to said hollow second main frame track arm near a second end of said hollow second main frame track arm;

g. a duplicate pair of hinge plates affixed to said second end of said second main frame track arm;

h. a plurality of through holes in each of said duplicate pair of hinge plates;

i. a second support arm through hole;

j. removable fourth holding means for holding said support arm component fixed at an angle to said hollow second main frame track arm insertable through one of said plurality of through holes in one of said hinge plates through said second support arm through hole and through one of said plurality of through holes in an other one of said hinge plates;

k. a running wheel component affixed to a first end of said support arm;

l. a holding foot component affixed to a second end of said support arm and perpendicularly aligned with said support arm;

m. a rubbery, tacky foot pad affixed to said holding foot component;

n. a plurality of keyhole shaped apertures in a top side of said first main frame track arm, in a top side of said second main frame track arm and in a top side of said extension arm component;

o. a first triangularly shaped plank holding bracket component;

p. a three sided first triangularly shaped base leg member of said first plank holding bracket component;

q. a first base pin affixed to a bottom side of said first base leg member near a first end of said first base leg member;

r. a second base pin affixed to said bottom side of said first base leg member near a second end of said first base leg member;

s. said first base pin and said second base pin being slideably insertable, one each into any of said keyhole shaped apertures;

t. a first leg member of said first triangularly shaped plank holding bracket pivotably affixed to a duplicate pair of first base leg hinge plates by way of fifth holding means each of which said duplicate pair of first base leg hinge plates are in turn attached to a top side of said first base leg member near said first end of said first base leg member;

u. a second leg member of said first triangularly shaped plank holding bracket pivotably affixed at a first end thereof by way of ninth holding means to said first leg member of said first triangularly shaped plank holding bracket;

v. a first duplicate pair of holding plates affixed, one each to each one of a pair of lateral sides of said first base leg member near said second end of said first base leg member;

w. a through hole in said second leg member near a second end thereof;

x. a duplicate pair of through holes in each of said first duplicate pair of holding plates;

y. seventh holding means insertable through one through hole of said pair of through holes in a first one of said first duplicate pair of holding plates, through said through hole in said second leg member and through a corresponding through hole of said duplicate pair of through holes in a second one of said first duplicate pair of holding plates;

z. a first duplicate pair of chair shaped lateral support units, one of said first duplicate pair of chair shaped lateral support units being attached to an outer portion of a first one of said pair of lateral sides of said first base leg member and to an outer portion of one of said first duplicate pair of holding plates and the other of said first duplicate pair of chair shaped lateral support units being attached to an outer portion of a second one of said pair of lateral sides of said first base leg member and to an outer portion of a second one of said first duplicate pair of holding plates;

aa. a rubbery, tacky foot pad attached to a bottom side of each member of said first duplicate pair of chair shaped lateral support units;

bb. a plank bar;

cc. a plurality of three sided plank holding groove members affixed to a frontal side of said plank bar;

dd. a second triangularly shaped plank holding bracket component;

ee. a base leg member of said second triangularly shaped plank holding bracket component;

ff. a third base pin affixed to a bottom side of said base leg member near a first end of said base leg member;

gg. a fourth base pin affixed to said bottom side of said base leg member near a second end of said base leg member;

hh. said third base pin and said fourth base pin being slideably insertable, one each into any of said keyhole shaped apertures;

ii. a first leg member of said second triangularly shaped plank holding bracket component being pivotably affixed to a second duplicate pair of base leg hinge plates by way of eighth holding means, each of which said second duplicate pair of base leg hinge plates are in turn attached to said first base leg member near said first end of said first base leg member;

jj. a second leg member of said second triangularly shaped plank holding bracket component pivotably affixed at a first end thereof by way of ninth holding means to said first leg member of said second triangularly shaped plank holding bracket component;

kk. a second duplicate pair of holding plates affixed, one each to each one of a pair of lateral sides of said base leg member near said second end of said base leg member;

ll. a through hole in said second leg member of said second triangularly shaped plank holding bracket component near a second end thereof;

mm. a second duplicate pair of through holes in each of said second duplicate pair of holding plates;

nn. tenth holding means insertable through one through hole of said pair of through holes in a first one of said second duplicate pair of holding plates, through said through hole in said second leg member and through a corresponding through hole of one of said duplicate pair of through holes in a second one of said second duplicate pair of holding plates;

oo. a second duplicate pair of chair shaped lateral support units, one of said second duplicate pair of chair shaped lateral support units being attached to an outer portion of a first one of said pair of lateral sides of said base leg member and to an outer portion of one of said second duplicate pair of holding plates and the other of said second duplicate pair of chair shaped lateral support units being attached to an outer portion of a second one of said pair of lateral sides of said base leg member and to an outer portion of a second one of said second duplicate pair of holding plates;

pp. a rubbery, tacky foot pad attached to a bottom side of each member of said second duplicate pair of chair-shaped lateral support units;

qq. a pair of three sided plank bar holding members affixed to a back side of said second leg member of said second triangularly shaped plank holding bracket component;

rr. said plank bar being pivotably affixed to a lowest one of said pair of three sided plank bar holding members;

ss. a first lateral side of a highest one of said pair of three sided plank bar holding members having a first pair of holding member through holes;

tt. a second lateral side of said highest one of said three sided pair of plank bar holding members having a second pair of holding member through holes corresponding to said first pair of holding member through holes;

uu. eleventh holding means insertable through one of said first pair of holding member through holes in said first lateral side of said highest one of said pair of plank bar holding members and through a corresponding one of said second pair of holding members through holes in said second lateral side of said highest one of said pair of plank bar holding members;

vv. a first lateral side of said lowest one of said pair of three sided plank bar holding members having a first through hole in it;

ww. a second lateral side of said lowest one of said pair of three sided plank bar holding members having a second through hole in it;

xx. a base through hole in said plank bar, and;

yy. twelfth holding means insertable through said first through hole in said first lateral side of said lowest one of said pair of three sided plank bar holding members, said base through hole and second through hole in said second lateral side of said lowest one of said pair of three sided plank bar holding members.

3. A roofer's safety brace, comprising:

a. a hollow first main frame track arm;

b. a hollow second main frame track arm;

c. first pin holding means insertable through through holes in said hollow first main frame track arm and through through holes in said hollow second main frame track arm for affixing said first main frame track arm at a second end thereof to said hollow second main frame track arm at a first end thereof;

d. an extension arm component insertable into a first end of said hollow first main frame track arm;

e. second pin holding means insertable through additional through holes in said hollow first main frame track arm and through additional through holes in said extension arm component for affixing said extension arm component into said first end of said hollow first main frame track arm;

f. a support arm component pivotably affixed, by way of third pin holding means insertable through a corresponding pair of second end track arm through holes and a first support arm through hole, to said hollow second main frame track arm near a second end of said hollow second main frame track arm;

g. a duplicate pair of hinge plates affixed to said second end of said second main frame track arm;

h. a plurality of through holes in each of said duplicate pair of hinge plates;

i. a second support arm through hole;

j. removable fourth pin holding means for holding said support arm component fixed at an angle to said hollow second main frame track arm insertable through one of said plurality of through holes in one of said hinge plates through said second support arm through hole and through one of said plurality of through holes in an other one of said hinge plates;

k. a running wheel component affixed to a first end of said support arm;

l. a holding foot component affixed to a second end of said support arm and perpendicularly aligned with said support arm;

m. a rubbery, tacky foot pad affixed to said holding foot component;

n. a plurality of keyhole shaped apertures in a top side of said first main frame track arm, in a top side of said second main frame track arm and in a top side of said extension arm component;

o. a first triangularly shaped plank holding bracket component;

p. a three sided first base leg member of said first triangularly shaped plank holding bracket component;

q. a first base pin affixed to a bottom side of said first base leg member near a first end of said first base leg member;

r. a second base pin affixed to said bottom side of said first base leg member near a second end of said first base leg member;

s. said first base pin and said second base pin being slideably insertable, one each into any of said keyhole shaped apertures;

t. a first leg member of said first triangularly shaped plank holding bracket pivotably affixed to a duplicate pair of first base leg hinge plates by way of fifth pin holding means each of which said duplicate pair of first base leg hinge plates are in turn attached to a top side of said first base leg member near said first end of said first base leg member;

u. a second leg member of said first triangularly shaped plank holding bracket pivotably affixed at a first end thereof by way of sixth pin holding means to said first leg member of said first triangularly shaped plank holding bracket;

v. a first duplicate pair of holding plates affixed, one each to each one of a pair of lateral sides of said first base leg member near said second end of said first base leg member;

w. a through hole in said second leg member near a second end thereof;

x. a duplicate pair of through holes in each of said first duplicate pair of holding plates;

y. seventh pin holding means insertable through one through hole of said pair of through holes in a first one of said first duplicate pair of holding plates, through said through hole in said second leg member and through a corresponding through hole of said duplicate pair of through holes in a second one of said first duplicate pair of holding plates;

z. a first duplicate pair of chair shaped lateral support units, one of said first duplicate pair of chair shaped lateral support units being attached to an outer portion of a first one of said pair of lateral sides of said first base leg member and to an outer portion of one of said first duplicate pair of holding plates and the other of said first duplicate pair of chair shaped lateral support units being attached to an outer portion of a second one of said pair of lateral sides of said first base leg member and to an outer portion of a second one of said first duplicate pair of holding plates;

aa. a rubbery, tacky foot pad attached to a bottom side of each member of said first duplicate pair of chair shaped lateral support units;

bb. a plank bar;

cc. a plurality of three sided plank holding groove members affixed to a frontal side of said plank bar;

dd. a second triangularly shaped plank holding bracket component;

ee. a base leg member of said second triangularly shaped plank holding bracket component;

ff. a third base pin affixed to a bottom side of said base leg member near a first end of said base leg member;

gg. a fourth base pin affixed to said bottom side of said base leg member near a second end of said base leg member;

hh. said third base pin and said fourth base pin being slideably insertable, one each into any of said keyhole shaped apertures;

ii. a first leg member of said second triangularly shaped plank holding bracket component being pivotably affixed to a second duplicate pair of base leg hinge plates by way of eighth pin holding means, each of which said second duplicate pair of base leg hinge plates are in turn attached to said first base leg member near said first end of said first base leg member;

jj. a second leg member of said second triangularly shaped plank holding bracket component pivotably affixed at a first end thereof by way of ninth pin holding means to said first leg member of said second triangularly shaped plank holding bracket component;

kk. a second duplicate pair of holding plates affixed, one each to each one of a pair of lateral sides of said base leg member near said second end of said base leg member;

ll. a through hole in said second leg member of said second triangularly shaped plank holding bracket component near a second end thereof;

mm. a second duplicate pair of through holes in each of said second duplicate pair of holding plates;

nn. tenth pin holding means insertable through one through hole of said pair of through holes in a first one of said second duplicate pair of holding plates, through said through hole in said second leg member and through a corresponding through hole of one of said duplicate pair of through holes in a second one of said second duplicate pair of holding plates;

oo. a second duplicate pair of chair shaped lateral support units, one of said second duplicate pair of chair shaped lateral support units being attached to an outer portion of a first one of said pair of lateral sides of said base leg member and to an outer portion of one of said second duplicate pair of holding plates and the other of said second duplicate pair of chair shaped lateral support units being attached to an outer portion of a second one of said pair of lateral sides of said base leg member and to an outer portion of a second one of said second duplicate pair of holding plates;

pp. a rubbery, tacky foot pad attached to a bottom side of each member of said second duplicate pair of chair-shaped lateral support units;

qq. a highest pair of plank bar holding members with each member thereof being perpendicularly affixed to a back side of said second leg member of said second triangularly shaped plank holding bracket component;

rr. a lowest pair of plank bar holding members with each member thereof being perpendicularly affixed to a back side of said second leg member of said second triangularly shaped plank holding bracket component;

ss. a first pair of holding member through holes in a first member of said highest pair of plank holding members;

tt. a second pair of holding member through holes in a second member of said highest pair of plank holding members;

uu. a first through hole in a first member of said lowest pair of plank bar holding members;

vv. a second through hole in a second member of said lowest pair of plank bar holding members;

ww. eleventh pin holding means insertable through on of said first pair of holding member through holes and through a corresponding one of said second pair of holding member through holes, and;

xx. twelfth pin holding means insertable through said first through hole and said second through hole.

4. A roofer's safety brace, comprising:

a. a hollow first main frame track arm;

b. a hollow second main frame track arm;

c. first holding means insertable through through holes in said hollow first main frame track arm and through through holes in said hollow second main frame track arm at a first end for affixing said first main frame track arm at a second end thereof to said hollow second main frame track arm at a first end thereof;

d. an extension arm component insertable into a first end of said hollow first main frame track arm;

e. second holding means insertable through additional through holes in said hollow first main frame track arm and through additional through holes in said extension arm component for affixing said extension arm component into said first end of said hollow first main frame track arm;

f. a support arm component pivotably affixed, by way of third holding means insertable through a corresponding pair of second end track arm through holes and a first support arm through hole, to said hollow second main frame track arm near a second end of said hollow second main frame track arm;

g. a duplicate pair of hinge plates affixed to said second end of said second main frame track arm;

h. a plurality of through holes in each of said duplicate pair of hinge plates;

i. a second support arm through hole;

j. removable fourth holding means for holding said support arm component fixed at an angle to said hollow second main frame track arm insertable through one of said plurality of through holes in one of said hinge plates through said second support arm through hole and through one of said plurality of through holes in an other one of said hinge plates;

k. a running wheel component affixed to a first end of said support arm;

l. a holding foot component affixed to a second end of said support arm and perpendicularly aligned with said support arm;

m. a rubbery, tacky foot pad affixed to said holding foot component;

n. a plurality of keyhole shaped apertures in a top side of said first main frame track arm, in a top side of said second main frame track arm and in a top side of said extension arm component;

o. a first triangularly shaped plank holding bracket component;

p. a three sided first base leg member of said first triangularly shaped plank holding bracket component;

q. a first base pin affixed to a bottom side of said first base leg member near a first end of said first base leg member;

r. a second base pin affixed to said bottom side of said first base leg member near a second end of said first base leg member;

s. said first base pin and said second base pin being slideably insertable, one each into any of said keyhole shaped apertures;

t. a first leg member of said first triangularly shaped plank holding bracket pivotably affixed to a duplicate pair of first base leg hinge plates by way of fifth holding means each of which said duplicate pair of first base leg hinge plates are in turn attached to a top side of said first base leg member near said first end of said first base leg member;

u. a second leg member of said first triangularly shaped plank holding bracket pivotably affixed at a first end thereof by way of sixth holding means to said first leg member of said first triangularly shaped plank holding bracket;

v. a first duplicate pair of holding plates affixed, one each to each one of a pair of lateral sides of said first base leg member near said second end of said first base leg member;

w. a through hole in said second leg member near a second end thereof;

x. a duplicate pair of through holes in each of said first duplicate pair of holding plates;

y. seventh holding means insertable through one through hole of said pair of through holes in a first one of said first duplicate pair of holding plates, through said through hole in said second leg member and through a corresponding through hole of said duplicate pair of through holes in a second one of said first duplicate pair of holding plates;

z. a first duplicate pair of chair shaped lateral support units, one of said first duplicate pair of chair shaped lateral support units being attached to an outer portion of a first one of said pair of lateral sides of said first base leg member and to an outer portion of one of said first duplicate pair of holding plates and the other of said first duplicate pair of chair shaped lateral support units being attached to an outer portion of a second one of said pair of lateral sides of said first base leg member and to an outer portion of a second one of said first duplicate pair of holding plates;

aa. a rubbery, tacky foot pad attached to a bottom side of each member of said first duplicate pair of chair shaped lateral support units;

bb. a plank bar;

cc. a plurality of three sided plank holding groove members affixed to a frontal side of said plank bar;

dd. a second triangularly shaped plank holding bracket component;

ee. a base leg member of said second triangularly shaped plank holding bracket component;

ff. a third base pin affixed to a bottom side of said base leg member near a first end of said base leg member;

gg. a fourth base pin affixed to said bottom side of said base leg member near a second end of said base leg member;

hh. said third base pin and said fourth base pin being slideably insertable, one each into any of said keyhole shaped apertures;

ii. a first leg member of said triangularly shaped plank holding bracket component being pivotably affixed to a second duplicate pair of base leg hinge plates by way of eighth holding means, each of which said second duplicate pair of base leg hinge plates are in turn attached to said first base leg member near said first end of said first base leg member;

jj. a second leg member of said second triangularly shaped plank holding bracket component pivotably affixed at a first end thereof by way of ninth holding means to said first leg member of said second triangularly shaped plank holding bracket component;

kk. a second duplicate pair of holding plates affixed, one each to each one of a pair of lateral sides of said base leg member near said second end of said base leg member;

ll. a through hole in said second leg member of said second triangularly shaped plank holding bracket component near a second end thereof;

mm. a second duplicate pair of through holes in each of said second duplicate pair of holding plates;

nn. tenth holding means insertable through one through hole of said pair of through holes in a first one of said second duplicate pair of holding plates, through said through hole in said second leg member and through a corresponding through hole of one of said duplicate pair of through holes in a second one of said second duplicate pair of holding plates;

oo. a second duplicate pair of chair shaped lateral support units, one of said second duplicate pair of chair shaped lateral support units being attached to an outer portion of a first one of said pair of lateral sides of said base leg member and to an outer portion of one of said second duplicate pair of holding plates and the other of said second duplicate pair of chair shaped lateral support units being attached to an outer portion of a second one of said pair of lateral sides of said base leg member and to an outer portion of a second one of said second duplicate pair of holding plates;

pp. a rubbery, tacky foot pad attached to a bottom side of each member of said second duplicate pair of chair-shaped lateral support units;

qq. a highest pair of plank bar holding members with each member thereof being perpendicularly affixed to a back side of said second leg member of said second triangularly shaped plank holding bracket component;

rr. a lowest pair of plank bar holding members with each member thereof being perpendicularly affixed to a back side of said second leg member of said second triangularly shaped plank holding bracket component;

ss. a first pair of holding member through holes in a first member of said highest pair of plank holding members;

tt. a second pair of holding member through holes in a second member of said highest pair of plank holding members;

uu. a first through hole in a first member of said lowest pair of plank bar holding members;

vv. a second through hole in a second member of said lowest pair of plank bar holding members;

ww. eleventh holding means insertable through one of said first pair of holding member through holes and through a corresponding one of said second pair of holding member through holes, and;

xx. twelfth holding means insertable through said first through hole and said second through hole.

5. The roofer's safety brace of claim 1 whereby said eleventh pin holding means are insertable through one of said first pair of holding member through holes in said first lateral side of said highest one of said pair of plank bar holding members, through a superior through hole located above said base through hole in said plank bar, and through a corresponding one of said second pair of holding member through holes in said second lateral side of said highest one of said pair of plank bar holding members.

6. The roofer's safety brace of claim 2 whereby said eleventh holding means are insertable through one of said first pair of holding member through holes in said first lateral side of said highest one of said pair of plank bar holding members, through a superior through hole located above said base through hole in said plank bar, and through a corresponding one of said second pair of holding member through holes in said second lateral side of said highest one of said pair of plank bar holding members.

7. The roofer's safety brace of claim 3 whereby said eleventh pin holding means are insertable through one of said first pair of holding member through holes, through a superior through hole located above said base through hole in said plank bar and through a corresponding one of said second pair of holding member through holes.

8. The roofer's safety brace of claim 4 whereby said eleventh holding means are insertable through said one of said first pair of holding member through holes, through a superior through hole located above said base through hole in said plank bar and through a corresponding one of said second pair of holding member through holes.

* * * * *